US009003585B2

(12) United States Patent
Salin et al.

(10) Patent No.: US 9,003,585 B2
(45) Date of Patent: Apr. 14, 2015

(54) POCKET KNIFE WITH SEPARABLE BODY PORTIONS

(71) Applicant: Wenger S.A., Delémont (CH)

(72) Inventors: Arnaud Salin, Hérimoncourt (FR); Pierre-Alain Jeandupeux, Delémont (CH)

(73) Assignee: Wenger S.A., Delémont (CH)

( * ) Notice: Subject to any disclaimer, the term of this patent is extended or adjusted under 35 U.S.C. 154(b) by 379 days.

(21) Appl. No.: 13/706,767

(22) Filed: Dec. 6, 2012

(65) Prior Publication Data

US 2013/0192004 A1 Aug. 1, 2013

(30) Foreign Application Priority Data

Jan. 27, 2012 (EP) ..... 12152834

(51) Int. Cl.

| | |
|---|---|
| ***B26B 11/00*** | (2006.01) |
| ***B26B 1/10*** | (2006.01) |
| ***B25B 15/00*** | (2006.01) |
| *B25F 1/04* | (2006.01) |

(52) U.S. Cl.

CPC ... *B26B 1/10* (2013.01); *B25F 1/04* (2013.01); *B25B 15/008* (2013.01); *B26B 11/00* (2013.01); *B26B 11/001* (2013.01)

(58) Field of Classification Search

CPC ..... B25F 1/04; B25B 15/008; B26B 11/00; B26B 11/001

USPC ..... 7/118, 128, 129, 138; 30/152–155

See application file for complete search history.

(56) References Cited

U.S. PATENT DOCUMENTS

| | | | | |
|---|---|---|---|---|
| 4,750,267 | A * | 6/1988 | Boyd | 30/161 |
| 4,783,867 | A * | 11/1988 | Tsao | 7/160 |
| 6,101,654 | A * | 8/2000 | Cachot | 7/128 |
| 6,216,301 | B1 * | 4/2001 | Rivera | 7/128 |
| 6,412,130 | B1 * | 7/2002 | Kershaw et al. | 7/129 |
| 6,510,767 | B1 * | 1/2003 | Rivera | 81/440 |
| 6,941,604 | B2 * | 9/2005 | Ackeret | 7/160 |
| 7,032,483 | B2 * | 4/2006 | Liu | 81/490 |
| 7,997,170 | B1 * | 8/2011 | Martinez et al. | 81/427.5 |
| 8,087,115 | B2 * | 1/2012 | Barber et al. | 7/167 |

(Continued)

FOREIGN PATENT DOCUMENTS

| | | |
|---|---|---|
| EP | 1195230 A2 | 4/2002 |
| WO | 2012126532 | 9/2012 |

*Primary Examiner* — Monica Carter
*Assistant Examiner* — Danny Hong
(74) *Attorney, Agent, or Firm* — Cooper Legal Group, LLC

(57) ABSTRACT

A pocket knife including a first body portion including a first engaging member, and a second body portion including a second engaging member arranged to engage the first body portion with the second body portion. The first body portion and the second body portion are separated from each other when not engaged. A tool element is arranged to be housed in the first body portion when in a closed state and displaced outward when in an opened state. A first locking member is arranged to be actuated by the tool element, and cooperates with a second locking member provided on the second body portion, and wherein when the first engaging member is engaged with the second engaging member, and when the first locking member and the second locking member are prevented from moving, the first body portion and the second body portion are prevented from being separated.

17 Claims, 7 Drawing Sheets

(56) References Cited

U.S. PATENT DOCUMENTS 8,490,523 B2 * 7/2013 Tsai et al. ..... 81/440
2008/0163433 A1 * 7/2008 Nenadic ..... 7/128
2013/0025071 A1 * 1/2013 Keng ..... 7/118

* cited by examiner

POCKET KNIFE WITH SEPARABLE BODY PORTIONS

TECHNICAL FIELD

The present invention relates to the field of pocket knives, also known as clasp knives, pen-knives, or Swiss knives. In particular, the invention relates to multifunctional pocket knives having separable body elements.

BACKGROUND OF THE INVENTION

Pocket knives having multiple blades and attachments are well known in the prior art. European patent application EP1195230, for example, discloses a multifunctional pocket knife having multiple blades and attachments such as pliers, detachable screwdriver bits, knife blades, tin-opener, bottle opener, etc.

Also known in the prior art are pocket tool kits, such as might be used by cyclists for small bicycle repairs when on the road. These pocket tool kits may include wrenches also known as spanners. British patent application GB0026040, for example, describes a multi-tool in which wrench tools of different sizes are combined in one compact combination unit.

Sometimes it would be beneficial to be able to divide a pocket knife into at least two separate knife portions and then to be able to use these parts individually, separated from each other. For instance, one knife portion could comprise a fork and another knife portion could comprise a knife. In this case, a mechanism is needed for locking the different knife portions together, when not used separately, and for unlocking these knife portions, when used separately, for example during eating. Also these different knife portions should not unlock accidentally, but at the same time the locking/unlocking mechanism should be easy and simple to use.

It is the object of the present invention to overcome the problems identified above related to separation of different knife portions of a pocket knife.

SUMMARY OF THE INVENTION

According to a first aspect of the invention, there is provided a pocket knife as recited in claim 1.

Thus, the present invention provides a multi-sectional or separable pocket knife that has at least two body parts that can be easily and reliably separated from each other. As the unlocking of the body portions are actuated by one of the tool elements, there is no need for a separate locking and/or unlocking mechanism. This of course saves space in the pocket knife, and makes it smaller and lighter. Also by using the solution of the present invention, an accidental unlocking of the body portions can be prevented.

Other aspects of the invention are recited in the dependent claims attached hereto.

BRIEF DESCRIPTION OF THE DRAWINGS

Other features and advantages of the invention will become apparent from the following description of a non-limiting exemplary embodiment, with reference to the appended drawings, in which.

DETAILED DESCRIPTION OF AN EMBODIMENT OF THE INVENTION

Figure 1:
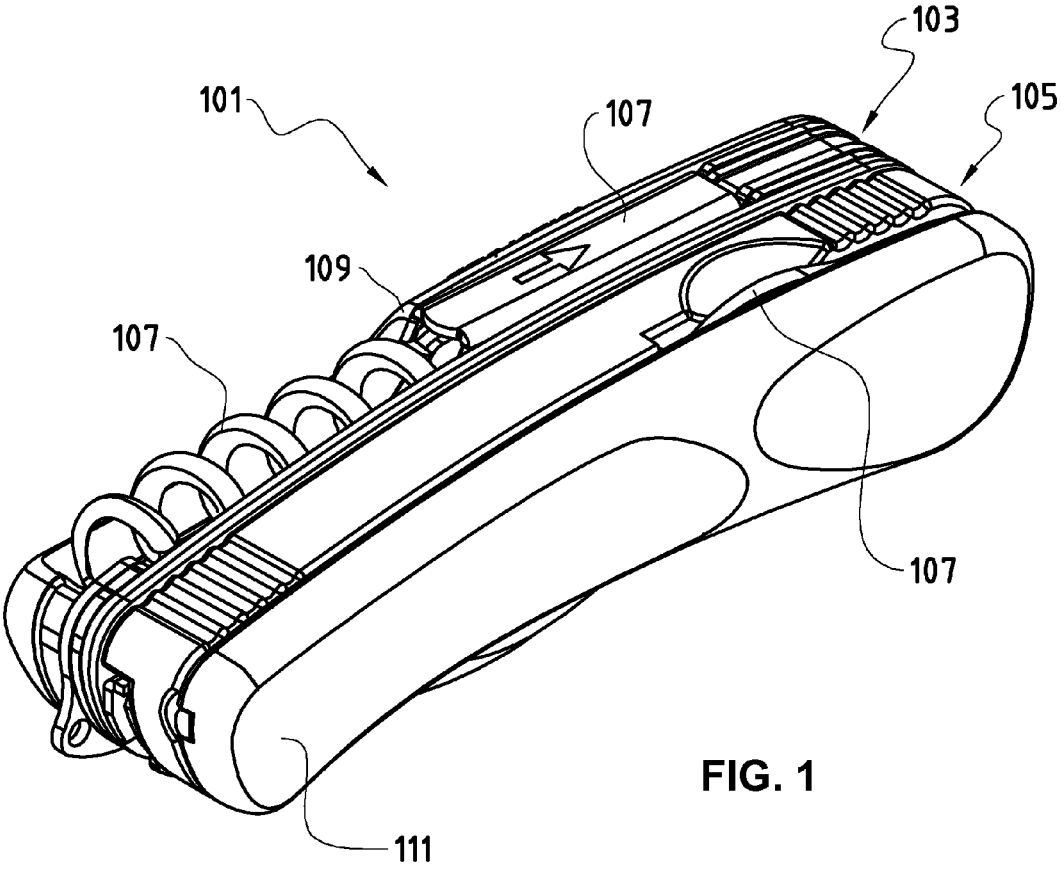
FIG. 1 is a schematic perspective view of a pocket knife according to the present invention, when in an assembled state.

An embodiment of the present invention will be described in the following in more detail with reference to the attached figures. Identical functional and structural elements which appear in the different drawings are assigned the same reference numerals.

A pocket knife 101 may be implemented as a multifunctional pocket tool, as depicted in FIG. 1, which is a schematic perspective view illustrating the pocket knife 101 according to one embodiment when the knife is in an assembled state. In the context, of the present invention, understood by a pocket knife is a multifunctional pocket tool, even if this pocket tool does not necessarily comprise a knife. The pocket knife 101 of FIG. 1 comprises a first body portion 103, a second body portion 105 and in this example various tools elements 107 or simply tools 107, such as a corkscrew, a bottle or can opener, knives, screwdrivers, and pocket tool kits, such as might be used by cyclists for small bicycle repairs when on the road, etc.

The pocket knife 101 also comprises a first lateral side 109 and a second lateral side 111, the sides of the knife body portions 103, 105 serving as a handle for the tool, and an interior space between said sides serving as housing to accommodate the various tools and implements when they are in a retracted or closed state as shown in FIG. 1. The various tools 107 are rotatable out from within the knife body portions 103, 105, and can be used in their opened state (this state is not illustrated in the figures).

Figure 2:
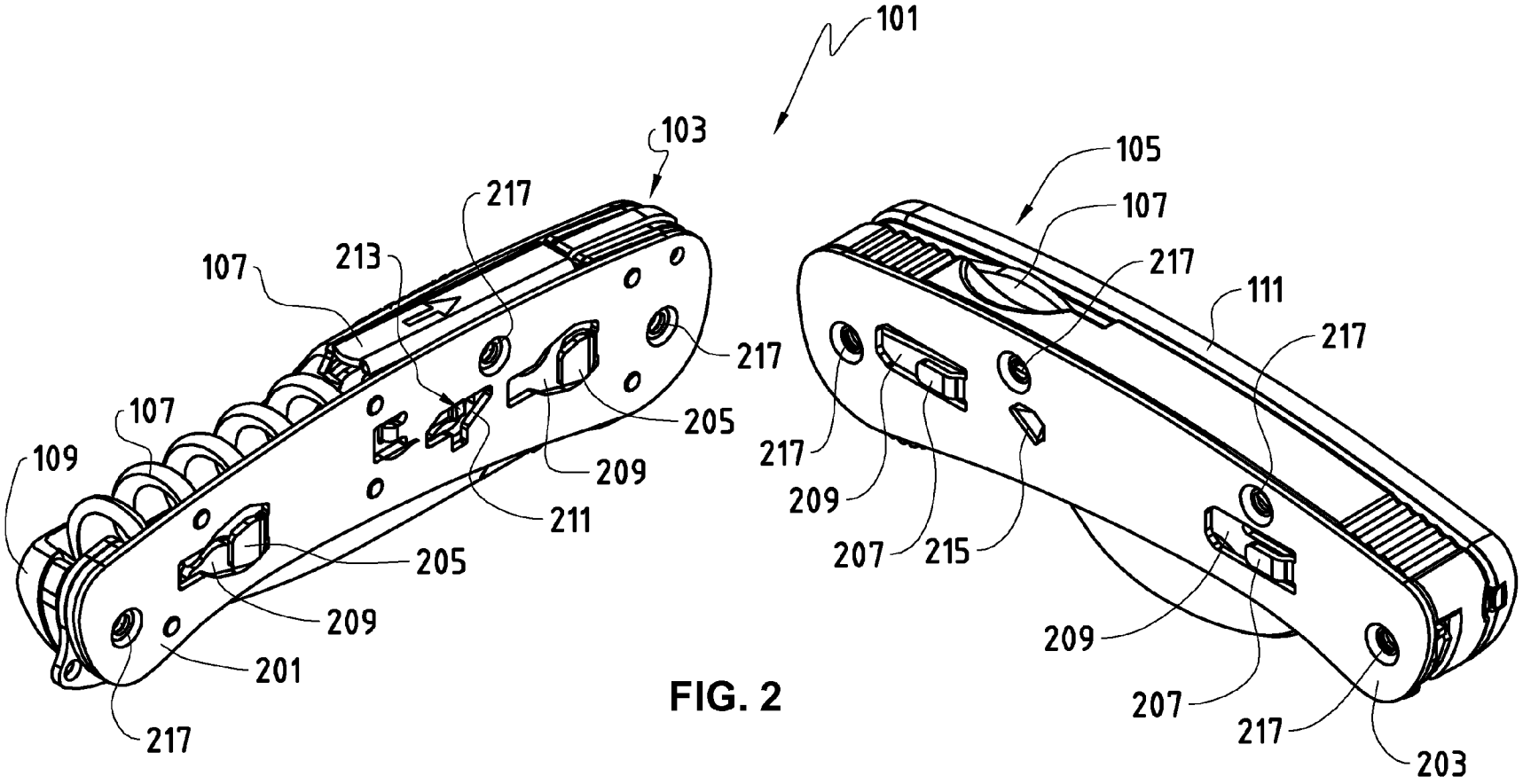
FIG. 2 is a schematic perspective view of a pocket knife according to the present invention, when in a disassembled state.

FIG. 2 illustrates the two knife body portions 103, 105 (or simply knife portions) when separated from each other. As can be seen, the first body portion 103 is at least partly defined by the first lateral side 109 and a first lateral element or plate 201. In a corresponding manner, the second body portion 105 is at least partly defined by the second lateral side 111 and a second lateral element or plate 203. These plates can be made of plastic or metal, such as steel, or other material.

As is further seen in that figure, the first body portion 103 has in this example two first engaging members 205, such as first engaging lugs 205, or simply lugs 205, which protrude slightly from the surface of the first lateral plate 201. Each first lug 205 is arranged to engage with a second engaging member 207, such as a second engaging lug 207 provided on the second body portion 105, and more specifically on the second lateral plate 203. These lugs 207 protrude slightly from the surface of the second lateral plate 203 so that these lugs 207 can engage with the first lugs 205 of the first body portion 103. First openings 209, which are longitudinal in this example, are provided around the lugs 205, 207 to facilitate the engagement and disengagement process. These openings extend in the direction of the lugs from the point where the lugs connect to the respective lateral plates. Thus, the first and second body portions comprise recesses around the lugs 205, 207.

Figure 3:
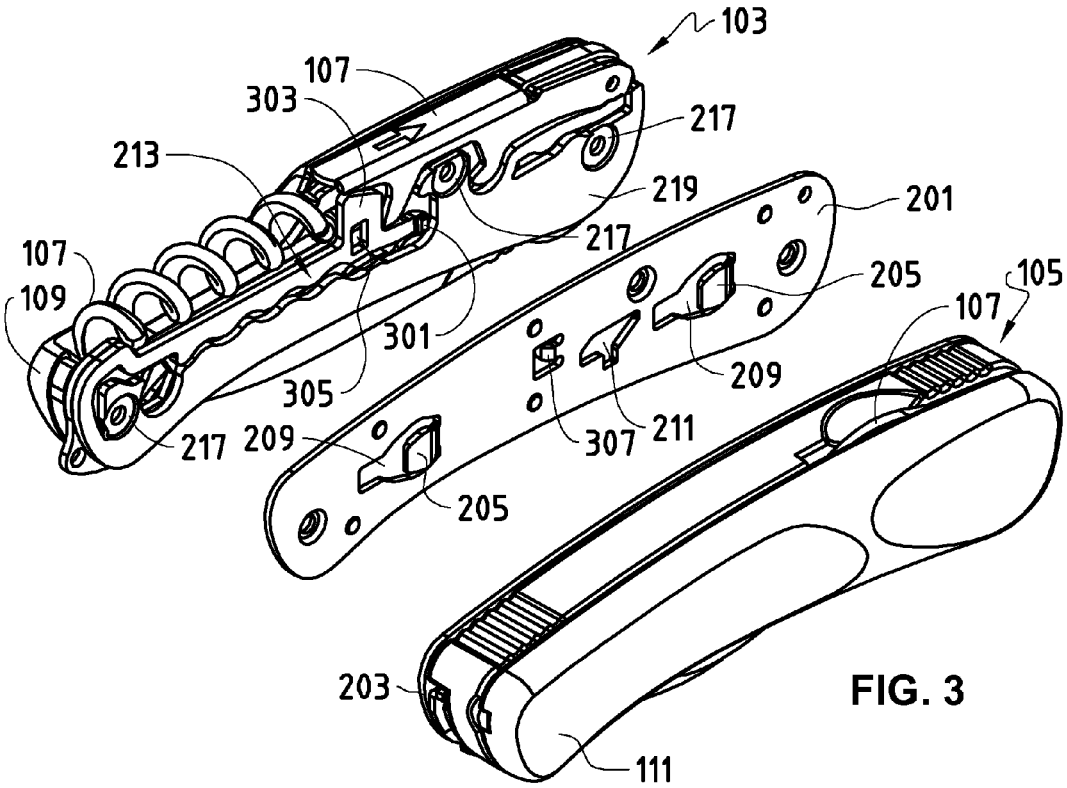
FIG. 3 is a schematic perspective view of a pocket knife according to the present invention, when in a disassembled state and when a lateral plate is separated from a first knife body portion.
Figure 4:
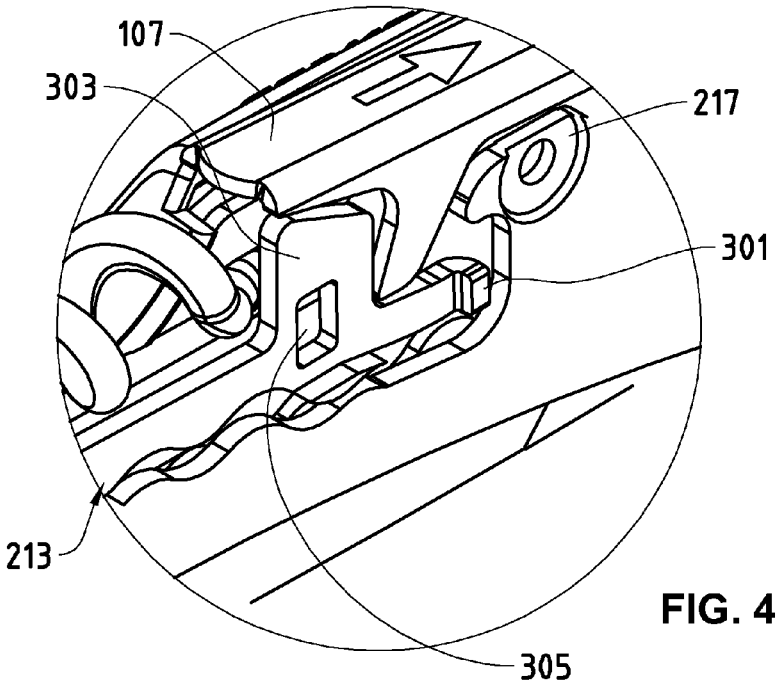
FIG. 4 is a detailed view showing more details of the first knife body portion illustrated in FIG. 3.

On the first lateral plate 201 there is also provided a second opening 211 or a central opening 211 which is arranged to receive one end of a first locking member 213, which is better shown in FIGS. 3 and 4. The central opening is also arranged to receive a second locking member 215 or a protrusion 215 provided on the second body portion 105, and more specifically on the second lateral plate 203 between the two lugs 207. In this example the lugs 207 and the protrusion 215 are all substantially aligned, although they do not have to be aligned. Various components of the knife are held together by rivet elements 217 in the known manner.

As can be seen in FIGS. 3 and 4, the first locking member 213 is in this example a spring blade 213, or leaf 213, for example made of metal, such as hardened steel. Other materials can be used too as long as the material is suitable to function as a spring. In this example, the bottom surface of the blade 213 has a wavy shape. This spring blade 213 has at its free end a protrusion 301 which is received in the central opening 211, when the first lateral plate 201 is in place in the first body portion 103. This protrusion 301 protrudes laterally from the longitudinal body portion of the spring blade 213. This protrusion 301 in this example is achieved by turning the free end of the spring blade 213 so that the protruding part forms approximately a 90 degree angle with respect to the body of the spring blade 213 and extends towards the second body portion when these two portions are engaged. The other end of the spring blade 213, i.e. the end opposite to the free end, makes a loop at the end of the first body portion 103 around an end rivet 217 to connect smoothly to a supporting plate 219 forming part of the first body portion 103. In this example the spring blade 213 is integral with the supporting plate 219.

In this example the spring blade 213 has also an upward extending portion 303, or projection 303 to form one contact point with the tool 107, which in this case is a bottle opener. The extending portion 303 has an opening 305 that is arranged to receive a protrusion 307 that is provided on the first lateral plate 201. This protrusion 307, when in the opening 305, defines the range of vertical movement (i.e. gives vertical maximal limits to the movement) of the spring blade 213. The spring blade 213 is urged upwards when opening the bottle opener 107, and the spring blade 213 moves vertically downwards when pressing on the bottle opener 107. In this example, the tool 107 has two contact points, one on top of the extending portion 303 and another one in the corner formed by the extending portion 303 and the spring body portion which is the longitudinal part of the blade 213.

Figure 5:
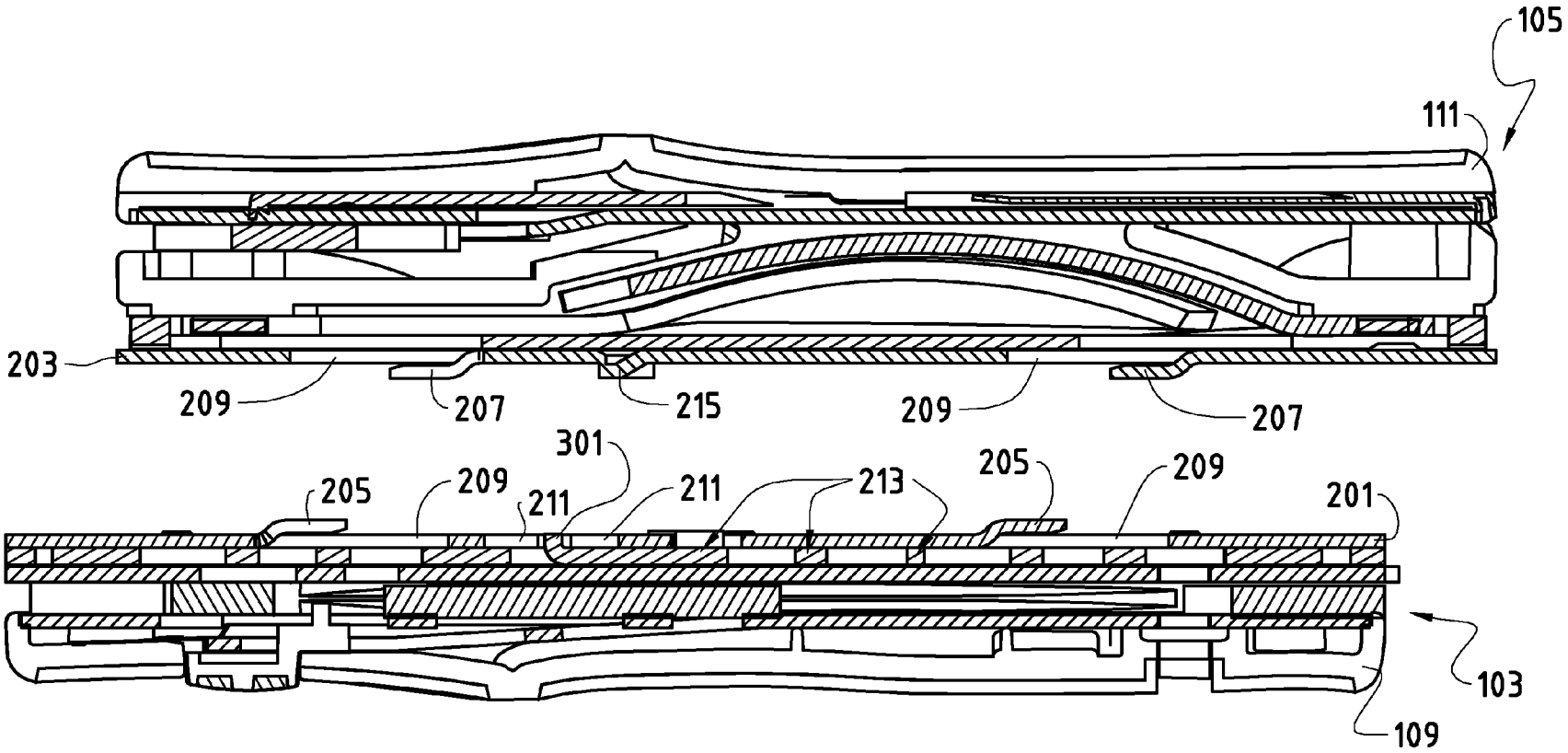
FIG. 5 is a cross-sectional top view of the first knife body portion and of the second knife body portion when separated from each other.

FIG. 5 is a cross-sectional top view illustrating the two body portions 103, 105 when separated from each other. In this example both the first and second lugs 205, 207 protrude slightly from the surface of the respective body portions. However, in a variant, it would be possible to have only either the first or the second lug to protrude from the respective body portion. In this situation one of the engaging members could be a lug, while the other of the engaging members could simply be an engaging surface.

Figure 6:
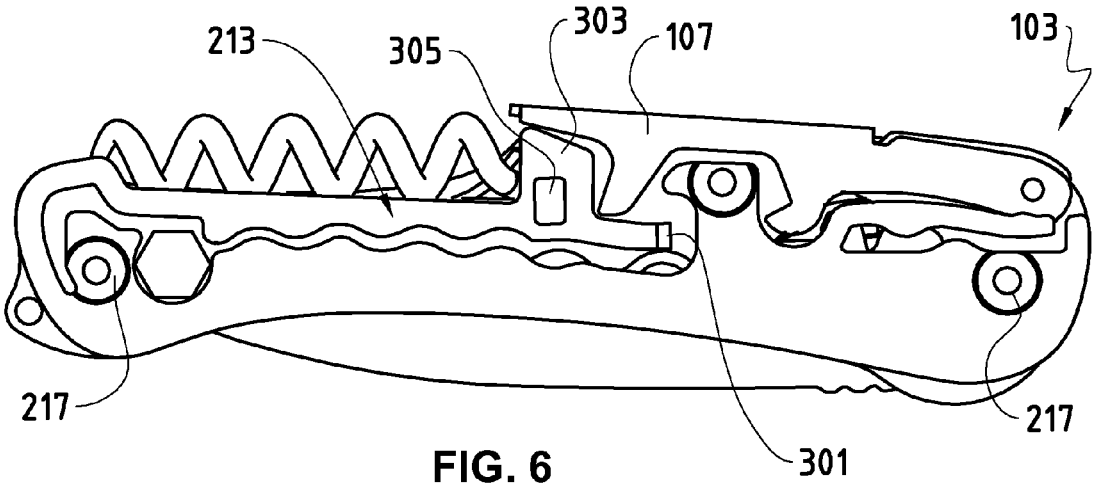
FIG. 6 is a side view of the first knife body portion without the lateral plate, showing a spring blade in its normal position.
Figure 7:
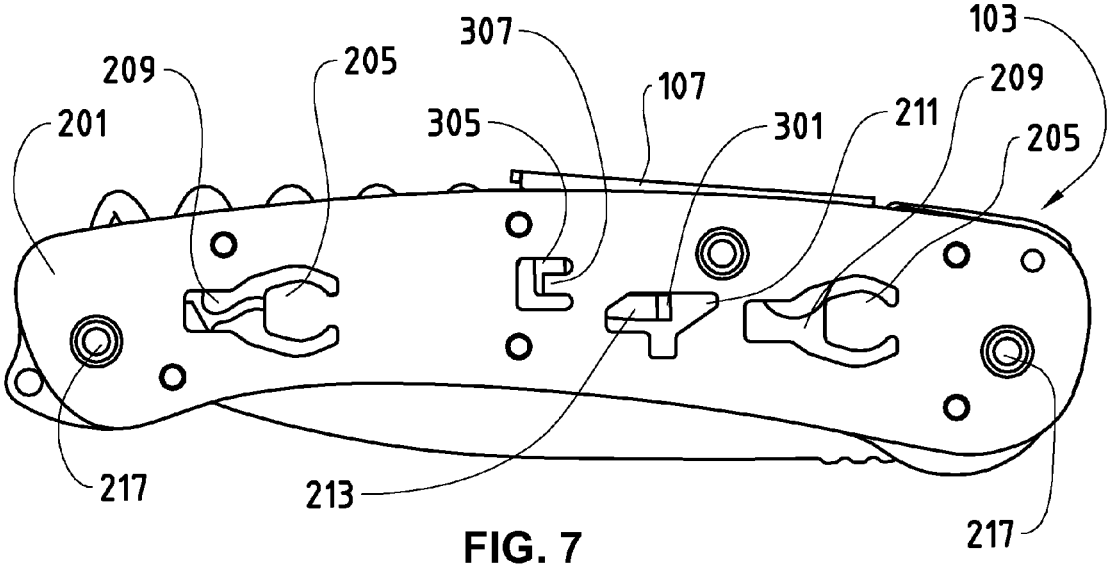
FIG. 7 is a side view of the first knife body portion, the spring blade being in the position shown in FIG. 6 and the first lateral plate being shown.
Figure 8:
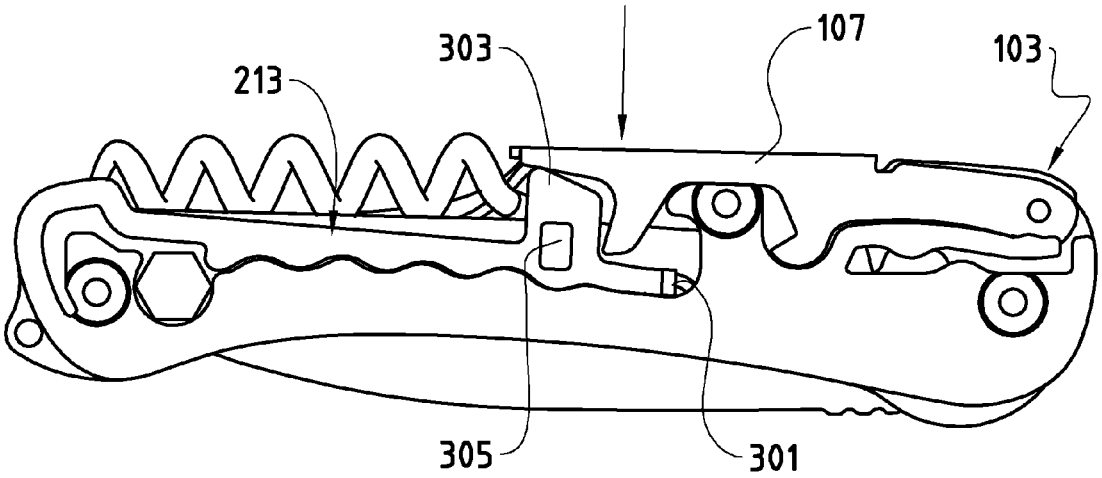
FIG. 8 is a side view of the first knife body portion, without the lateral plate, showing the spring blade when actuated by a tool.
Figure 9:
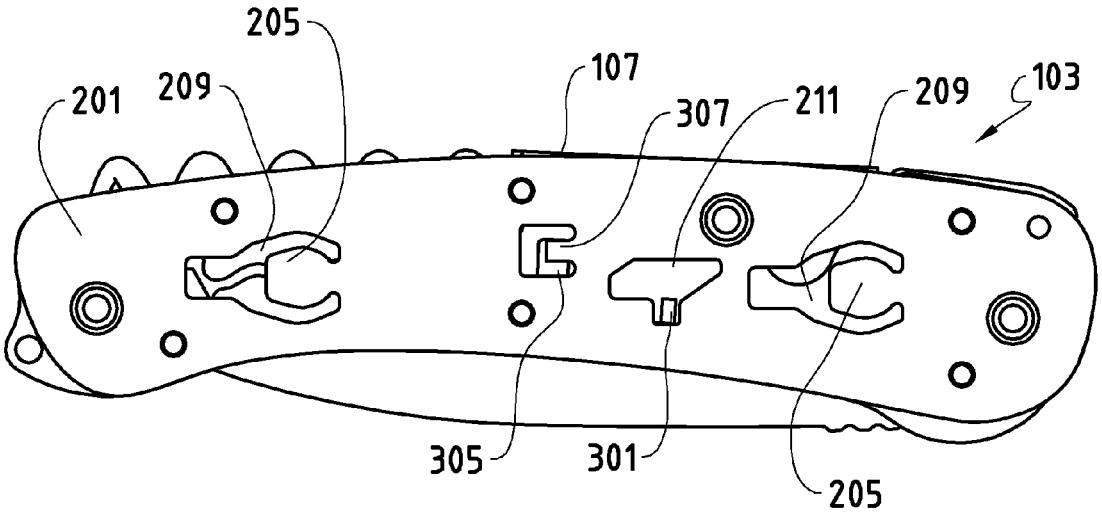
FIG. 9 is a side view of the first knife body portion, the spring blade being in the position shown in FIG. 8 and the lateral plate being shown.

FIG. 6 is a side view of the first body portion 103, without the first lateral plate 201, showing the spring blade 213 in its rest position, i.e. when the tool 107 is not pressed. FIG. 8 shows the same situation when the first lateral plate 201 is in place. FIG. 7, on the other hand, illustrates the situation where the spring blade 213 is actuated by pressing down one end of the bottle opener 107 as indicated by the arrow, and FIG. 9 shows the same situation when the first lateral plate 201 is in place.

Figure 10:
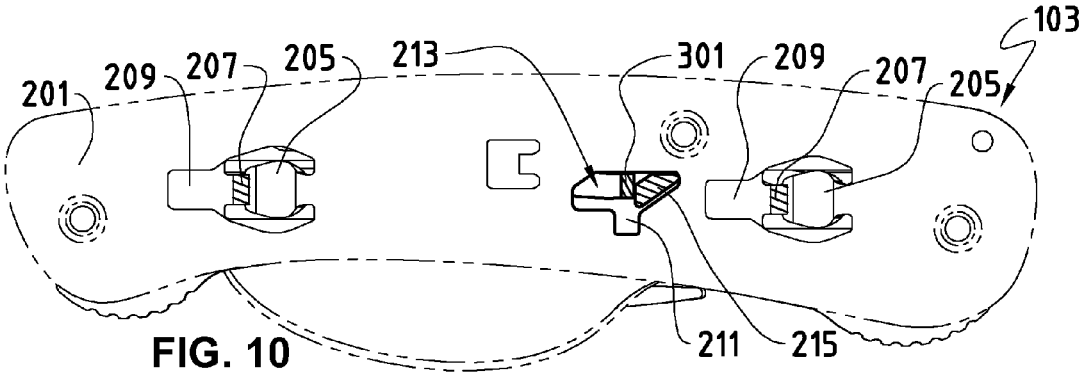
FIGS. 10-13 are cross sections of the first knife body portion illustrating the functioning of the locking mechanism by showing different states of the locking means and the engagement means.

FIGS. 10 to 13 are cross sectional views of the first body portion 103 showing in more detail how the locking mechanism functions to lock the first body portion 103 and the second body portion 105 together. When the first and second lugs 205, 207 are engaged and when the bottle opener 107 is not pressed, then the protrusion 215 is locked in the central opening 211 between the blade protrusion 301 and the central opening walls of the first lateral plate 201 as shown in FIG. 10. In this situation, the first body portion 103 and the second body portion 105 cannot move with respect to each other.

Figure 11:
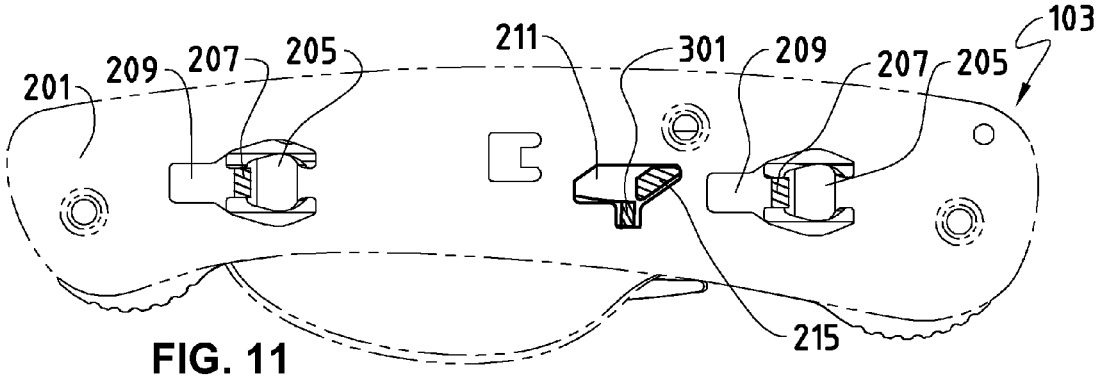
Figure 12:
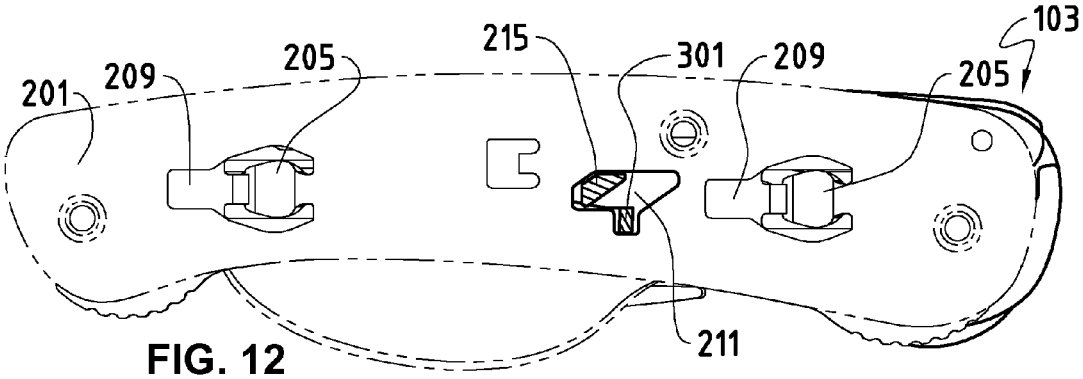

FIG. 11 shows the situation where the end of the bottle opener tool 107 that is above the extending portion 303 is pressed downwards to move down the free end of the spring blade 213 and thus the protrusion 301. In this state, as the two body portions 103, 105 are not yet moved with respect to each other, these body portions 103, 105 are still engaged, but no longer locked. Now to disengage the two body portions, the second body portion 105 can be slid to the left (in the figures) and the second lugs 207 thereby disengage from the first lugs 205. The body portions 103, 105 are still in contact with each other but the sliding movement is possible thanks to the longitudinal openings 209. When measured from the free end of the first lug 205, the openings in the first lateral plate 201 extend to the left (in the figures) preferably by at least a length that equals the length of the second lugs 207. As shown in FIG. 12, the protrusion 215 is now moved to the left end of the central opening 211. Now the two body portions 103, 105 can be simply separated from each other by for instance moving the second body portion 105 in the direction which is perpendicular to the surface of the first lateral plate 201.

Figure 13:
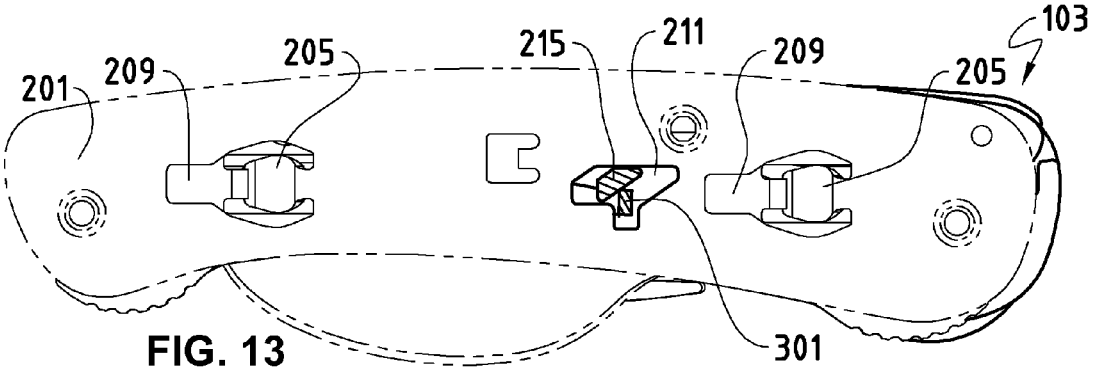

FIG. 13 illustrates the situation where the second lugs 207 can slide to the right (in this figure) within the openings 209 to be engaged with the first lugs 205. As the leading edge of the protrusion 215 forms a relatively sharp edge due to the shape of this element, the protrusion 215 can displace the blade protrusion 301 downwards without the need for a user to actually press the bottle opener 107.

While the invention has been illustrated and described in detail in the drawings and foregoing description, such illustration and description are to be considered illustrative or exemplary and not restrictive, the invention being not limited to the disclosed embodiment. Other embodiments and variants are understood, and can be achieved by those skilled in the art when carrying out the claimed invention, based on a study of the drawings, the disclosure and the appended claims. For instance, the blade protrusion 301 could be arranged to move perpendicularly to the surface (facing the second body portion 10) of the first lateral plate 201 instead of moving parallel to this surface, i.e. vertically in the figures. Of course, the combination of these movements is also possible. In the embodiment described above, each of the body portions comprises two lugs. However, any number of lugs is possible as long as a desired engagement can be achieved between the first body portion 103 and the second body portion 105. For instance, only one lug could be provided on each body portion. Alternatively more than two lugs on each body portion could be provided.

Furthermore, in the illustrated example, it is the bottle opener 107 that is arranged to actuate the spring blade 213. However, the actuator tool could be any other tool instead of the bottle opener, for instance a corkscrew. Moreover, in the illustrated embodiment both the first body portion 103 and the second body portion 105 accommodate tools. However, it is possible that only the first body portion could accommodate tools, while the second body element would be simply a cover element. The user can also easily personalise his pocket knife by, for instance, replacing the second body portion with another second body portion having a cover of a different colour for instance, or when going for a bike trip, the user could replace the second body portion 105 with another second body portion accommodating special tools suitable for bicycle repairs.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the invention.

The invention claimed is:

1. A pocket knife comprising: a first knife body portion comprising a first engaging member, a second knife body portion comprising a second engaging member arranged to engage with the first engaging member to engage the first knife body portion with the second knife body portion, the first knife body portion and the second knife body portion being arranged to be separated from each other when not engaged, a tool element arranged to be housed in the first knife body portion when the tool element is in a closed state, and displaced outward from the first knife body portion when the tool element is in an opened state; wherein the first knife body portion comprises a first locking member arranged to be actuated by the tool element, and arranged to cooperate with a second locking member provided on the second knife body portion, and wherein when the first engaging member is engaged with the second engaging member, and when the first locking member and the second locking member are prevented from moving with respect to each other, the first knife body portion and the second knife body portion are prevented from being separated.

2. A pocket knife according to claim 1, wherein the first locking member and the second locking member are in a locked state fixed with respect to each other when the first locking member is not actuated by the tool element, and the first locking member and the second locking member are in an unlocked state free to move with respect to each other when the first locking member is actuated by the tool element thereby allowing disengagement of the knife body portions.

3. A pocket knife according to claim 1, wherein the first locking member is a spring blade having at least one contact point with the tool element.

4. A pocket knife according to claim 3, wherein the spring blade has a longitudinal body and an extending portion extending from the longitudinal body, and wherein the extending portion forms the at least one contact point with the tool element.

5. A pocket knife according to claim 1, wherein the spring blade has a first protrusion protruding laterally from a spring blade body and arranged to be received in a first opening on a side of the first knife body portion facing the second knife body portion, when the knife body portions are engaged.

6. A pocket knife according to claim 5, wherein the first protrusion is arranged to move parallel to the surface of the first knife body portion that faces the second knife body portion, when the knife body portions are engaged, or the first protrusion is arranged to move perpendicularly to this surface, or the first protrusion is arranged to move to a direction that is a combination of the aforementioned perpendicular and parallel movements.

7. A pocket knife according to claim 1, wherein the second locking member is a second protrusion on a side of the second knife body portion facing the first knife body portion, when the knife body portions are engaged, and the second protrusion is arranged to be received in a first opening on a side of the first knife body portion facing the second knife body portion when the knife body portions are engaged.

8. A pocket knife according to claim 1, wherein the first and second engaging members are lugs.

9. A pocket knife according to claim 8, wherein the lugs protrude slightly from the respective surfaces of the knife body portions.

10. A pocket knife according to claim 1, wherein the tool element is a bottle opener.

11. A pocket knife according to claim 1, wherein first and second body portions comprise openings or recesses around the engaging members to facilitate sliding of the second body portion with respect to the first body portion, when disengaging the knife body portions from each other, or when engaging the knife body portions.

12. A pocket knife according to claim 1, wherein the actuation is done by pressing on the tool element.

13. A pocket knife according to claim 1, wherein the second locking member has a sharp edge that is arranged to displace one end of the first locking member without actuating the tool element, when engaging the first knife body portion with the second knife body portion.

14. A pocket knife according to claim 1, wherein the first knife body portion and the second body portion are arranged to accommodate at least one of the following: a knife, a fork and a spoon.

15. A pocket knife according to claim 1, wherein the first knife body portion comprises at least two first engaging members, and the second knife body portion comprises at least two second engaging members.

16. A pocket knife according to claim 1, wherein the first knife body portion has a third opening or recess arranged to receive a movement limitation member to define limits for the movement of the first locking member.

17. A pocket knife according to claim 1, wherein the first knife body portion comprises a first lateral plate and the second knife body portion comprises a second lateral plate and wherein the first engaging member is integral with the first lateral plate, while the second engaging member and the second locking member are integral with the second lateral plate.

* * * * *

UNITED STATES PATENT AND TRADEMARK OFFICE

CERTIFICATE OF CORRECTION

PATENT NO. : 9,003,585 B2
APPLICATION NO. : 13/706767
DATED : April 14, 2015
INVENTOR(S) : Arnuad Salin et al.

It is certified that error appears in the above-identified patent and that said Letters Patent is hereby corrected as shown below:

In the Specification

Column 4, line 63, please delete "10)" and insert --105)--

Signed and Sealed this
Twenty-ninth Day of September, 2015

Michelle K. Lee

Michelle K. Lee
*Director of the United States Patent and Trademark Office*